US006053999A

United States Patent [19]

Marcus

[11] Patent Number: 6,053,999

[45] Date of Patent: Apr. 25, 2000

[54] FIBERFILL STRUCTURE

[75] Inventor: Ilan Marcus, Versoix, Switzerland

[73] Assignee: E. I. du Pont de Nemours and Company, Wilmington, Del.

[21] Appl. No.: 09/089,892

[22] Filed: Jun. 4, 1998

Related U.S. Application Data

[62] Division of application No. 08/871,875, Jun. 6, 1997, Pat. No. 5,851,665

[60] Provisional application No. 60/020,671, Jun. 28, 1996, abandoned.

[51] Int. Cl.[7] ..... B32B 31/16

[52] U.S. Cl. ..... 156/73.2; 156/270; 156/290; 156/308.4

[58] Field of Search ..... 156/73.1, 73.2, 156/73.3, 250, 270, 271, 290, 308.2, 308.4, 580.1, 580.2; 264/442, 443, 444

[56] References Cited

U.S. PATENT DOCUMENTS

| | | | |
|---|---|---|---|
| 3,271,189 | 9/1966 | Hofmann | 117/138.8 |
| 3,454,422 | 7/1969 | Mead et al. | 117/138.8 |
| 3,892,909 | 7/1975 | Miller | 428/371 |
| 4,259,400 | 3/1981 | Bolliand | 428/288 |
| 4,414,045 | 11/1983 | Wang et al. | 156/73.2 |
| 4,418,103 | 11/1983 | Tani et al. | 428/4 |
| 4,419,160 | 12/1983 | Wang et al. | 156/73.2 |
| 4,555,421 | 11/1985 | Yasue | 428/6 |
| 4,605,454 | 8/1986 | Sayovitz et al. | 156/73.1 |
| 4,618,531 | 10/1986 | Marcus | 428/283 |
| 4,783,364 | 11/1988 | Marcus | 428/288 |
| 4,794,038 | 12/1988 | Marcus | 428/288 |
| 4,818,599 | 4/1989 | Marcus | 428/288 |
| 4,940,502 | 7/1990 | Marcus | 156/272.2 |
| 5,112,684 | 5/1992 | Halm et al. | 428/357 |
| 5,169,580 | 12/1992 | Marcus | 264/115 |
| 5,294,392 | 3/1994 | Marcus | 264/118 |
| 5,500,295 | 3/1996 | Halm et al. | 428/357 |

FOREIGN PATENT DOCUMENTS

| | | |
|---|---|---|
| 0 620 185 A | 10/1994 | European Pat. Off. . |
| 26 55 069 A1 | 6/1978 | Germany . |

*Primary Examiner*—James Sells

[57] ABSTRACT

A process of preparing new down-like clusters employs a method of point-bonding thermoplastic cut fibers in a stack of webs of carded fibers or continuous filaments in a tow, and then cutting and separating the resulting clusters which have an entirely different structure that is refluffable. Ultrasonic bonding has worked well as the bonding method, but other methods may prove useful.

4 Claims, 3 Drawing Sheets

FIBERFILL STRUCTURE

CROSS REFERENCE TO RELATED APPLICATION

This application is a division of application Ser. No. 08/871,875, filed Jun. 6, 1997, U.S. Pat. No. 5,851,665, and claims benefit of priority from my Provisional Application No. 60/020,671, filed Jun. 28, 1996 (DP-6515-P1), now abandoned.

FIELD OF INVENTION

This invention concerns improvements in and relating to fiberfill and, more particularly, to providing fiberfill in form of a new structure, namely fluffy distinct fiber clusters (puffs) in which the fibers are bonded together, and which may be refluffable, and to new processes for producing such new structures, and including articles filled therewith and related thereto, such as materials for use in molding and molded articles resulting therefrom and processes related thereto.

BACKGROUND

Synthetic filling materials have become well accepted as inexpensive filling materials in bedding, furniture, apparel articles and similar applications. These materials, generally made of polyester, are appreciated for their bulk and hand.

Fiberfill has traditionally been used in a form of carded webs which are cross-lapped to build up their thickness into batts which are then used to fill the pillows, quilts or other articles. A large variety of fibers with different cross sections, bulk, deniers and blends of the different fibers have been used to produce the desired resilience and softness, and have usually been coated with a silicone slickener coating to reduce the fiber/fiber friction and to give the batt better softness and improved recovery from compression, as disclosed, for example, by Hoffmann in U.S. Pat. No. 3,271,189 and in Mead U.S. Pat. No. 3,454,422; instead of a silicone, some non-Si slickeners have been used, as described in my U.S. Pat. No. 4,818,599 and art referred to therein and in other prior art.

A batt structure does not allow the filling to move around and shape itself to the user's contours and to be refluffed back to the original shape after use, unlike natural fillings. Down and down/feather blends are characterized by their ability to shape to the user's contours and to be easily refluffed by shaking and patting back to the original shape. So there have been several suggestions and attempts to replicate down-like properties using synthetic fibers.

Miller U.S. Pat. No. 3,892,909, entitled "Synthetic Down", suggested using two types of bodies made from synthetic fibers as a filler, e.g., for pillows. Miller suggested larger bodies in the form of a figure of revolution, such as spheres or cylinders, to make up most of the mass of the stuffing of a pillow, and feathery bodies to fill the voids between the larger bodies. Miller's feathery bodies were unilateral or bilateral bundles of staple fibers or filaments joined at the center (bilateral) or at one end (unilateral). Miller's bundles were sprayed with a compatible binder that was applied in such a way as to bind the fibers at points of intersection, and desirably to obtain uniform distribution of the binder throughout the entire extent of the body. Other methods suggested for preserving shape were fusion by conventionally applied heat, impulse heating, laser or ultrasonic energy and chemicals.

A later suggestion was by Tani et al. in U.S. Pat. No. 4,418,103. Tani suggested a process that started from a tow of crimped continuous filaments (e.g., of polyester), involving (1) opening the tow, (2) compressing the ends of the filaments (in an end of the tow) together to a specified very high fiber density in a narrow slit or groove, (3) cutting the tow (filaments) to expose a cut end surface, (4) fusing the ends of the filaments together while they were still maintained in their high fiber density compressed condition in the narrow slit or groove, (5) advancing the tow to advance the now fused ends of the filaments to a desired distance from the narrow slit or groove, and (6) cutting the tow filaments so they were released from the narrow slit or groove, and then repeating steps 4–6 while continuing to hold the end of the tow in compressed condition except insofar as he advanced the tow periodically in step (5). Tani said that, when his filaments were cut (step 6), they spread spherically or radially about the end that was fused. Tani illustrated his process in his FIG. 1. Tani said that the resulting spherical masses could be used as filling material. To obtain down-like filling material, Tani suggested dividing the spherical masses into smaller cotton-like material composed of about a dozen to 200 fibers, and illustrated this in his FIG. 2. Tani emphasized that the crimped fibers in his filling material were always bonded together at one end at high 20 density, while the other ends of the fibers stayed free. This was an inevitable result of Tani's process, because he fused the ends of his filaments, so that the cut fibers would be connected only at their ends, which is where they were fused (so his resulting filling material extended almost twice the (crimped) length that he cut). Tani indicated that he could use other bonding methods.

I believe that neither Miller's nor Tani's suggestions have ever been manufactured or sold commercially. In contrast, however, the problem of providing a fiberfill product with the ability to move around inside the ticking to shape to the user's contours and then be refluffed back to regain the original shape was essentially solved on a commercial scale in 1985–6 by the provision of fiberballs, as disclosed in my U.S. Pat. Nos. 4,618,531 and 4,783,364, and in U.S. Pat. No. 5,112,684, for example. These patents refer to various previous suggestions in the art for preparing substitutes for feather or down.

Fiberballs (or clusters, as they are referred to sometimes) have approached natural fillings such as down in reproducing their ability to move inside the ticking and refluff, and have been used successfully in pillows and furniture back cushions. Further improvements would, however, be desirable.

According to my present invention, I now provide a new structure that achieves three dimensional fiber distribution and has a narrow, small, bonding point analogous to what characterizes down. I regard it as important to have a fiber tuft with completely opened fibers, where there is no restriction to the complete development of the fibers' bulk other than a small bonding point, preferably only one such in each tuft. I regard a bonding point as necessary to avoid clumping and ensure refluffability by maintaining the identity of the individual tufts during use. Contrary to fiberballs, in which fibers have been rolled together and cluster identity is maintained by entanglement of the fibers, the fibers in the present invention are fully opened and develop their bulk fully. The structure of my invention can have the advantages of being soft, refluffable, washable in a laundry machine, and providing improved insulation. It combines the advantages of the refluffability of the fiberballs with the insulation of the fiber batts.

The tufts of my invention need not be only bonded at the ends of the fibers as Tani suggested, nor only joined at the center or at one end as Miller suggested, but may be at any location in the individual tuft. Indeed, a mixture, wherein the bonding locations vary along the lengths of the fibers, has been a result and characteristic of my new process and I have found that the fact that the bonding is not always at the same location for all the tufts of my invention has given excellent results and is an advantage.

The bonding itself can be achieved using different means, but I prefer bonding techniques which allow me to bond the fibers effectively using as small a section of the fibers as reasonably possible and damaging as little as possible of the bulk of the fiber sections adjacent to the bonding area, to maximize bulk. I have found that a convenient technique for achieving such bonding uses ultrasonic bonding.

SUMMARY OF THE INVENTION

According to the invention, there is provided an improvement in filling material, including articles filled therewith, and comprising clusters (that may be better termed "puffs" or "tufts", but I have mostly used the term clusters herein) of bonded thermoplastic fibers, the fibers having crimped configuration and being bonded together at a location that extends along a minor proportion, preferably 2 to 10%, of the length of the fibers, said improvement being characterized by the fibers being bonded at locations that vary in different clusters in the filling material. In other words, said bonding is not at the same location for all the clusters as described by Tani and by Miller, but at locations that vary along the lengths of the fibers in different clusters in the filling material.

The fibers in these clusters should desirably be completely open and fully free to develop their bulk, but are bonded so that the individual fibers are not completely free to move independently of one another. I have found this to be advantageous with regard to refluffability, as I have found this seems to reduce the ability of the clusters to entangle with one another. The fibers are bonded together at only a very limited location, relative to their surface area; such bonded area is desirably of small dimensions, not more than 20 mm, e.g., 1–20 mm×0.5–10 mm and desirably constitutes from 1 or 2 to no more than 30%, preferably no more than 15%, or 10%, and especially 1 to 5%, of the total area of the fibers or clusters. The clusters (puffs) desirably have sizes (dimensions) of 5 to 100 mm, preferably 1 to 5 cm, it being understood that the dimensions will usually depend on the desired end-use. More than 80% of the fibers are preferably bonded into the cluster. If desired, mixtures of fibers may be used, including mixtures of non-thermoplastic fibers, including natural fibers, especially if suitable bonding methods are used. For good refluffability, the number of unbonded fibers should generally be minimized. For other purposes, such as for bonded structures using binder fiber, using clusters of the invention to make molded products, for example, or other products using binder fibers, clusters of the invention may be used in admixture with cut fibers or natural fibers.

Desirably, the clusters of the invention have a controlled size distribution, such as the number of filaments per cluster and the dimensions of the clusters. Such control, like other advantages of my invention, is practicable because of my new process that is described hereinafter.

Suitable fibers can have a wide range of properties to produce fiberfill with different filling power and softness. They can be made of the same polymer or different polymers, can have the same denier and cross section, or be a blend of different deniers and/or cross sections. Suitable examples have been disclosed in the prior art on fiberballs referred to hereinabove, and, for example, in Tolliver U.S. Pat. No. 3,772,137, Jones et al EPA 2 No. 67 684, Broaddus U.S. Pat. No. 5,104,725, and Hernandez et al U.S. Pat. No. 5,458,971. The fibers are preferably 1 to 6 cm in (relaxed) length, and are preferably slickened, e.g., with 0.05 to 1.5% by weight of silicone slickner, as described in the fiberfill literature. Non-Si slickeners may also be used, as described for example in U.S. Pat. No. 4,818,599, and other disclosures of copolymers of polyalkylene oxides and aromatic polyesters. The crimped configuration of the fibers may be mechanical or so-called spiral, including blends of fibers with different bulk geometries. All or any of such fibers can be used to produce the fiber structures of the invention and the choice of type of crimp, crimp level, denier, cross-section and of blend(s) of fibers to be used provides an ability to change the properties of the product of the invention to tailor them to the specific needs of an end-use or a market. Reference may be made to earlier patents for further details, including U.S. Pat. Nos. 4,618,531, 4,783,364, and 5,112,684. Synthetic fibers are generally preferred for the practical reasons expressed therein, and most of the following description is directed to polyester fibers, as they have given very good results and have been generally preferred for use as fiberfill, but other synthetic polymers that are thermoplastics may be substituted, in whole or in part, for synthetic polyesters.

Although, for many filled articles, slickened fibers are often preferred for their aesthetics, the invention is also applicable to use of dry (non-slickened) fibers. Use of such non-slickened fibers may be particularly advantageous for use with binder fibers, for making molded products, for example, such as molded cushions and mattresses, using binder fibers mixed with load-bearing fibers to form the clusters, or mixing the clusters with binder fibers. Such binder fibers have been disclosed in the art, such as Frankosky et al U.S. Pat. No. 5,527,600 and the art disclosed therein, bicomponent binder fibers being generally preferred, especially sheath-core bicomponent fibers having a load-bearing core and a sheath of binder material. Thus, filled articles and filling material may comprise clusters in admixture with cut fibers comprising binder material that has been activated to create a bonded network.

There is also provided, according to the invention, a process for preparing clusters of bonded thermoplastic fibers that have a crimped configuration and that are 1 to 6 cm in length, comprising the steps of (1) forming the fibers into a stack of superposed webs of parallelised such fibers, (2) passing said stack through a bonding zone whereby the thermoplastic fibers in said stack are intermittently bonded together in a pattern, (3) cutting the resulting stack of intermittently bonded fibers, and (4) separating the resulting cut stack into clusters.

There is further provided, according to the invention, a process for preparing clusters of bonded thermoplastic fibers, comprising the steps of (1) forming a tow of continuous thermoplastic filaments that have a crimped configuration, (2) passing said tow through a tow spreader to open said tow, passing the opened tow through a bonding zone whereby the thermoplastic filaments in the tow are intermittently bonded together in a pattern of bonded sections, (3) cutting the resulting tow of intermittently bonded filaments, and (4) separating the resulting cut tow into clusters of cut fiber.

Preferably, after step (2), the intermittently bonded filaments in the tow are spread to separate the bonded sections, before the resulting tow is cut in step (3).

Further aspects of the invention and further details are given hereinafter.

DETAILED DESCRIPTION OF THE INVENTION

Figure 1A:
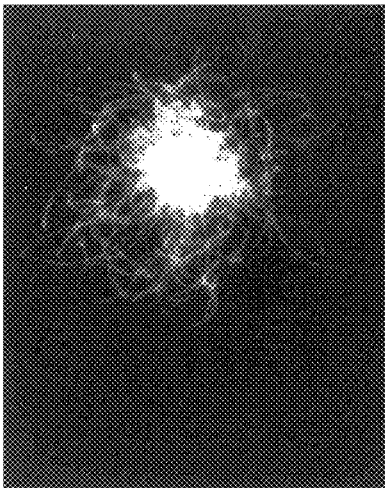
FIG.1A (PRIOR ART)
FIGS. 1A and 1B are photographs, FIG. 1B being a photograph of a cluster according to the invention and, for comparison, FIG. 1A (prior art) being a photograph of natural down.
Figure 1B:
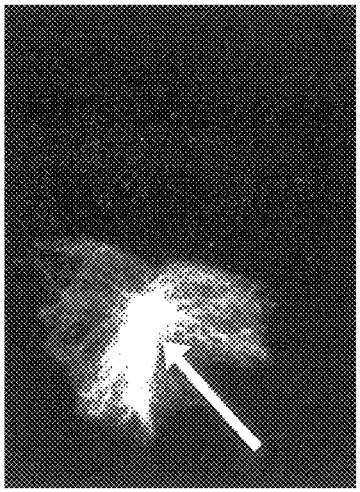

The nature of refluffable fiber clusters (puffs) of the invention can be seen from the photograph in FIG. 1, where a cluster of the invention is shown on the right side and, for comparison, a cluster of down on the left side of the photograph. Thus, the fiberfill of the invention is composed of individual clusters wherein the fibers are bonded in a small section which need not be at the end of the fibers but may be at any point along the lengths of the fibers, and is not at the same point for every cluster in the filling material.

Indeed, I have found it desirable to provide a mixture of products in which the bonding location varies along the lengths of the fibers, i.e., in some clusters the bonding location may be at or near the end of the fibers, whereas other clusters have their bonding locations at a significant distance from the ends of the fibers. I have been able to perform bonding that itself does not significantly reduce the crimp of the fibers in the vicinity of the bonded area. The fibers have a three dimensional distribution although, like in the natural products, they may not be uniformly distributed in all directions. This new structure is quite similar to the structure of down, but the fibers that I have used to produce the Examples have had no barbs. Use of fibers having barbs as starting material could further approach the intimate structure of the natural product.

Down is by nature non-uniform and changing in structure depending on the bird and from which location on the bird's body the down is plucked. Down can vary in the nature and size of the quill, the thickness of the filaments and the distribution of the filaments around the quill. The product of my invention can be made to reproduce such variations of structures by selecting the fibers or the fiber blends from which the fiberfill of the invention is made and by selecting process variables, such as an appropriate bonding pattern. The dimensions of the clusters can be controlled as well by selecting such variables as the starting material, the bonding pattern and conditions, the thickness of the fiber layer, and the cutting conditions.

My present invention provides also processes for producing such refluffable fiberfill of my invention. According to one aspect, staple fibers are carded, preferably with the webs superposed one on top of each other, rather than cross-lapped, and the resulting batt is passed through a bonding machine to produce an intermittent bonding pattern. Such a pattern preferably comprises rows of short, discontinuous bonded areas that are separated by small gaps. The bonded areas preferably have an elongated shape whose length is at an angle between 0 and 45 degrees to the axis of the bonding roll, i.e., between 45 and 90 degrees to the machine direction. I believe that the bonding can be achieved by various different means. I have found ultrasonic bonding to be particularly satisfactory because it has enabled me to bond only small areas (i.e., restricted areas) of the fiber surfaces, without significantly affecting the remainder of the fibers, or their properties, such as their crimp and bulk. The bonding rolls and ultrasonic horn (sonotrode) can be made to control the pattern precisely and, as indicated, the bonding has not harmed the bulk of the fibers in the immediate vicinity of the bonded area. For most fiberfill end-uses, it is important to maximize bulk and filling power. The bonded batt is then passed through a cutter and the cut length is desirably adjusted to be equal to or slightly shorter than the distance between the rows of the bonding roll. The cut material may then be separated into the individual down-like clusters by mechanical means, for instance by forcing the cut material through one or more rows of bars to break the material into individual tufts or clusters.

According to another aspect of the invention, the starting material is in a tow form. The tow is passed through a tow spreader to open the tow and separate the individual filaments and the opened tow is guided through a similar bonding machine. The bonded tow is then cut similarly to a cut length which is desirably equal to or slightly shorter than the distance between the rows of the bonding roll. I have found that the cut material produced from such a bonded tow may be separated very easily into individual clusters according to the invention as the filaments in a tow are generally much more oriented in the machine direction than the fibers in a carded batt of staple fibers. If desired, the intermittently bonded tow may be spread to separate the bonded sections prior to cutting, as was done in the Examples, and I have found this to be advantageous.

The tension in the bonding area is preferably controlled by driven rolls that are preferably located both upstream and downstream of the bonding roll. This permits precise control of the tension in the bonding area.

Figure 3:
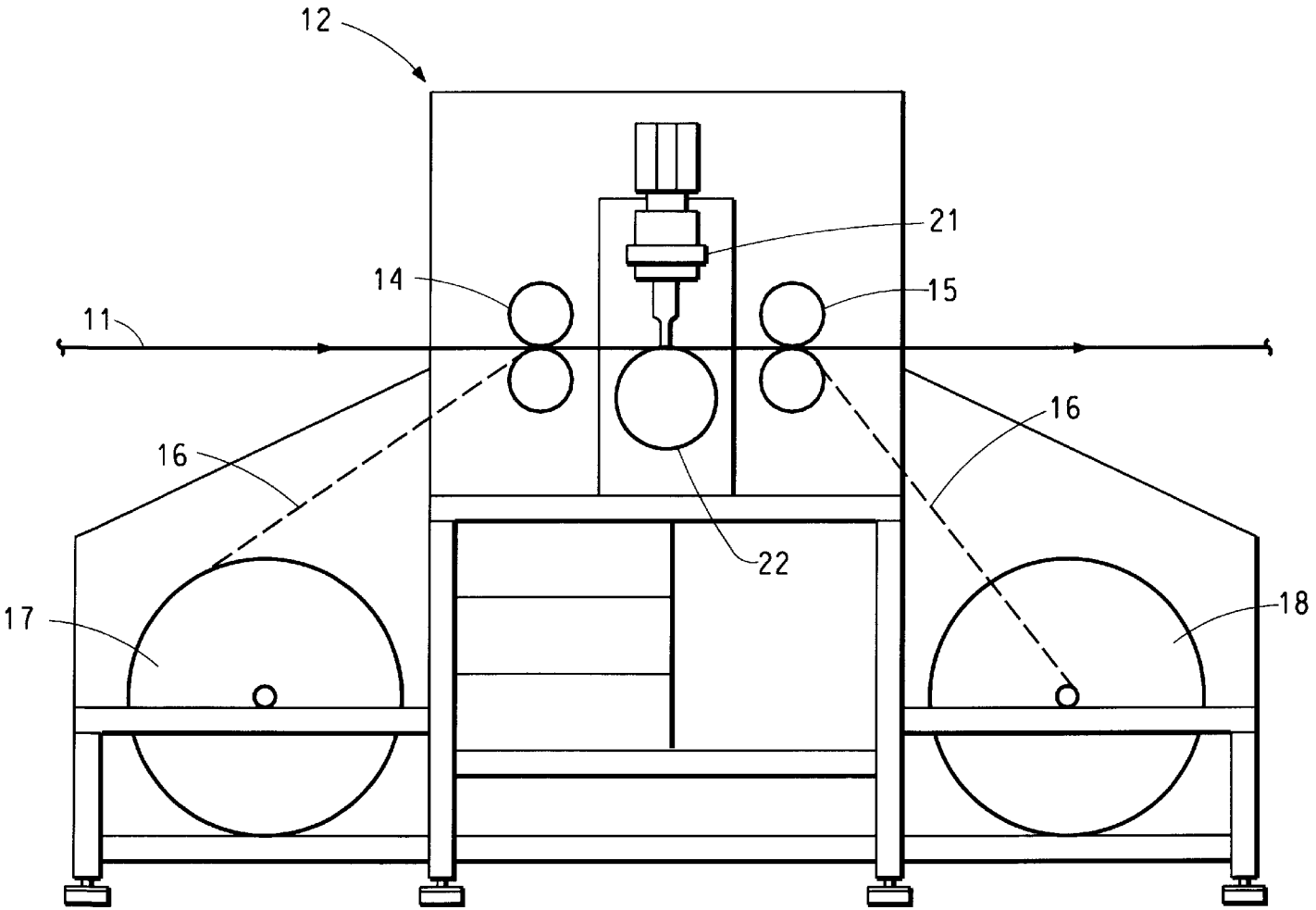
FIG. 3 is a schematic view in elevation of bonding equipment for use according to the invention.

Suitable bonding equipment will now be described with reference to FIG. 3 of the accompanying Drawings, in which either superposed webs of carded fibers or a tow that is spread out in flat form is bonded and, in either case, is represented in FIG. 3 by a flat web 11 that enters the bonding equipment, represented generally by 12, from the left side in FIG. 3. Web 11 passes first through the nip between a pair of driven rolls 14, before bonding, and then, after bonding, through the nip between a pair of driven rolls 15. If web 11 is accompanied through bonding machine 12 by paper, as a carrier, then such paper 16 is supplied from a paper supply roll 17. Web 11 and paper 16 pass together between the pair of driven rolls 14, then between ultrasonic horn 21 and bonding roll 22, and then between the pair of driven rolls 15. The paper carrier 16 then leaves pattern-bonded web 11 and is rewound onto a roll 18, while web 11 passes on to a cutter (not shown).

The clusters are preferably tumbled, or otherwise processed to improve their fluffiness, prior to packing into pillows or other filled articles, or prior to packaging.

The number of fibers in each individual cluster depends essentially on the fiber denier, the bonding pattern and the thickness of the fiber structure entering the bonding zone. These can be easily varied to produce the fiberfill of the invention with different cluster sizes, bulk, softness and shape.

The crimp geometry of the fibers has also a significant impact on the three dimensional fiber distribution in the individual clusters and consequently on the filling power, softness, size, and insulation of the fiberfill of the invention.

The process of the invention, when using the preferred method of ultrasonic bonding, has the advantage of being simple and inexpensive, requiring a relatively small investment. This makes it possible to practice the invention in small manufacturing units that may be located close to a customer to reduce transportation costs of the light and bulky fiberfill of the invention. The process of the invention is flexible, making it possible to produce a large range of new products and to tailor the products to the needs of specific markets. Costs may be further reduced by coupling a tow bonding process with a tow drawing operation.

Down has been used mostly in articles such as quilts, ski-wear, casual wear and similar articles requiring high insulation, as opposed to articles requiring high resilience or high recovery from compression, such as furniture cushions. The products of the invention are not, however, limited to these applications and may be tailored to the needs of articles such as pillows or furniture cushions by an appropriate selection of the feed fibers and the process conditions. Indeed, as described herein, the products of the invention may be used as feed material for making molded products and other objects, as contemplated in my U.S. Pat. Nos. 4,794,038, 4,940,502, 5,169,580, 5,294,392, and 5,500,295, by way of example.

EXAMPLES

The invention is further illustrated in the following Examples, using polyester fiber.

Figure 2:
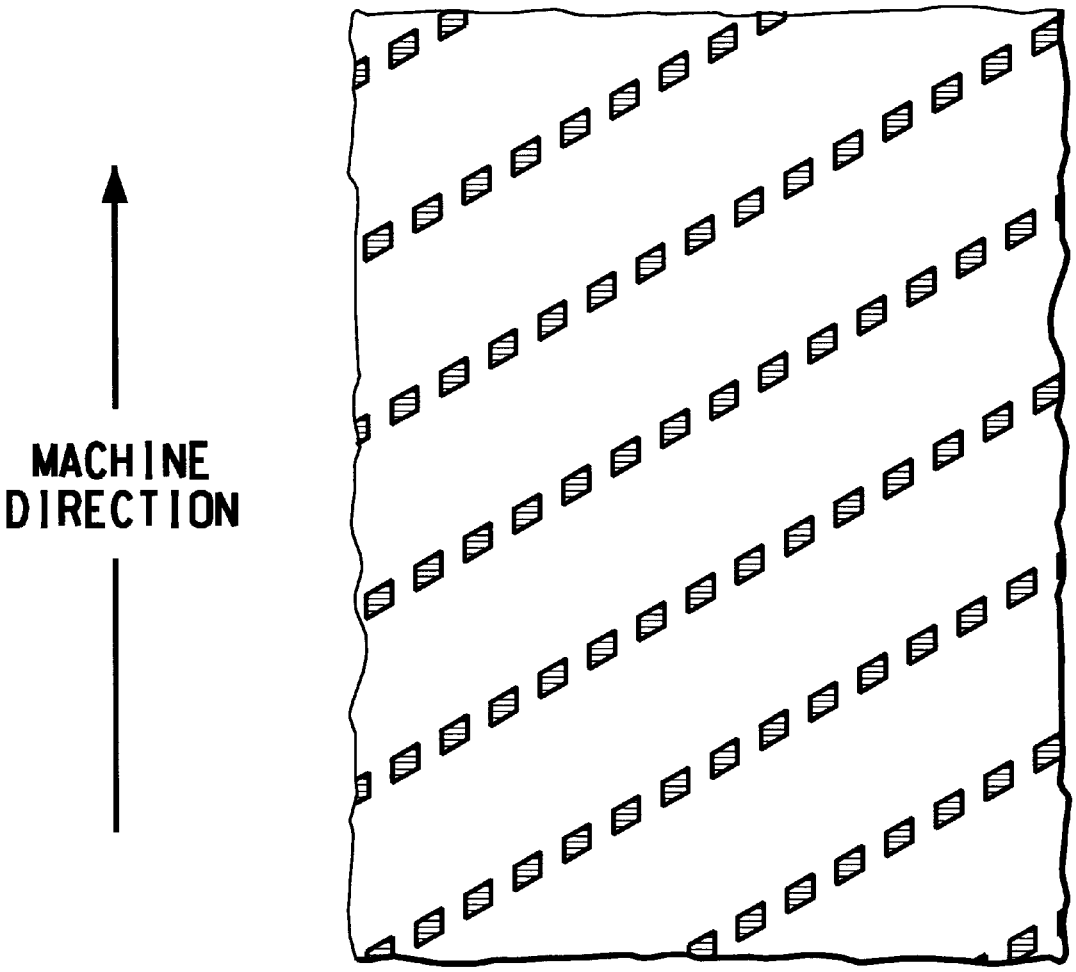
FIG. 2 is a schematic illustration of part of the designs for the patterned rolls that were used for the Examples.

The bonding equipment for Examples 1 to 3 was a 22 cm wide, single head, 20 kHz, Pinsonic machine at the British Textile Technology Group in Manchester, England, with a patterned bonding roll with a design that is partially shown in FIG. 2 (not to scale). Variations in techniques for achieving an intermittent bonding pattern include, for example, applying the pattern in other ways, e.g., providing raised strips on the bonding roll that are continuous and providing intermittent gaps in the application of ultrasound instead of using an ultrasonic foot (sometimes called a "horn" or a "sonotrode") that provides ultrasonic energy that is not interrupted across the whole width of the machine, and such could provide better results (fewer unbonded fibers). An ultrasonic method of bonding is preferred since it can melt the fibers intermittently at the points of contact between the roll and the foot in such a way that the melted portions solidify in a bonded state without significantly affecting the remainder of the fibers. The protrusions on the patterned bonding roll were of the following dimensions:

- 30 mm between the rows measured in machine direction (MD)
- 21 mm between the rows measured perpendicular to the rows
- 2 mm width of protrusions measured perpendicular to the rows
- 3 mm length of protrusions measured in cross direction (CD)
- 3 mm gap between protrusions measured in cross direction (CD)
- 3 mm depth of design (height of protrusions)
- 42 degree angle between rows and MD For Examples 1 to 3, see Table 1, batts were prepared by carding polyester staple fiber and superposing the carded webs in a stack, one on top of another to build the indicated batt weight per unit area, with the carded fibers oriented parallel to the bonding machine direction (MD). The batts were then cut to 20 cm wide strips in the machine direction and rolled together with paper, as a carrier for transportation to the ultrasonic bonding machine. These rolls were joined together at the entrance of the ultrasonic bonding machine to provide a roll with enough length of bonded material for feeding to the cutter. The bonded material was cut on a guillotine-type laboratory cutter, and the cut material was then separated into individual tufts by hand.

TABLE 1

| | Examples Produced from Staple | | |
|---|---|---|---|
| | 1 | 2 | 3 |
| Feed Fiber | | | |
| Batt Weight, g/m$^2$ | 240 | 200 | 300 |
| dtex/fil | 6.1 | 6.0 | 6.0 |
| cut length, mm | 75 | 50 | 50 |
| cross section | 7-hole | solid | solid |
| crimp | M | S | S |
| Bonding Conditions | | | |
| speed, m/min | 9 | 9 | 9 |
| horn pressure, kg/cm$^2$ | 1.05 | 1.05 | 1.5 |
| relative power, % | 70 | 70 | 70 |
| Cutting Lengths, mm | 28 and 22 | 28 | 28 |

Notes: All the above feed fibers were slickened with about 0.5% by weight of a commercial silicone slickener (corresponding to about 0.25% Si, this being the usual way to calculate, as % Si on the weight of the fiber); "M" and "S" indicate mechanical and spiral crimp, respectively; the 7-hole cross-section is described by Broaddus in U.S. Pat. No. 5,104,725, in contrast to the solid cross-sections, which were also of round peripheral cross-section.

Example 1

At 22 mm cutting length, the product separated easily into individual tufts. Relatively few filaments were bonded at more than one point, so they had to be broken or cut to separate them into individual tufts having only one bonding point per tuft, which are preferred.

At 28 mm cutting length, the separation was more difficult. Although the webs formed on the card had been carefully superposed, the carded fibers were not as parallelised as in the tows (see later Examples) and this resulted in a different distribution and orientation of the fibers around the bonded area.

The products showed small bonding areas at various locations along the fibers within the tufts, with the fibers fully opened and bulked.

Example 2

The 200 g/m$^2$ batts used as feed in this Example (from a spiral crimp product) were difficult to process, because of poor batt integrity. However, the resulting bonded material separated easily into individual tufts having a more rounded form than the product of Example 1, and the spiral crimp added softness and slickness to the product, as compared to Example 1.

Example 3

The only difference between the batts of Example 2 and Example 3 was the batt density (thickness), so a greater horn pressure was applied. The number of filaments per unit area of the 300 g/m$^2$ batts was much higher and this resulted in a much higher number of filaments per tuft. These tufts were more bulky and more resistant to compression. This illustrates one of the parameters which enables an operator to change the dimensions and the characteristics of the product of the invention.

The remaining Examples (see Table 2) were produced from tows (of continuous filaments) instead of from cut fibers in a stack of webs.

Examples 4, 4A and 5 were produced from tow products using a different roll design which was improved to reduce the number of unbonded fibers as well as the bonded area, and had the following characteristics:

row spacing (in MD): 28 mm angle of rows to roll axis: 30 degrees bonding sections: 3 mm long, 1 mm wide gap between adjacent bonding sections: 0.5 mm height of bonding sections: 1.5 mm height in gap: 0.75 mm (half height of bonding sections)

Material and conditions used for Examples 4, 4A and 5.

TABLE 2

| | 4 | 4A | 5 |
|---|---|---|---|
| Feed Fiber ktex | 48.9 | 48.9 | 46.7 |
| dtex/fil | 4.0 | 4.0 | 6.7 |
| cross section | hollow | hollow | hollow |
| crimp (CHI) | 10 | 10 | 9–10 |
| Bonding Conditions | | | |
| speed, m/min | 15 | 15 | 14 |
| horn pressure, kg/cm$^2$ | 1.5 | 1.0 | 1.4 |
| relative power, % | 60 | 60 | 60 |
| Cutting length mm | 24 | 24 | 24 |

Example 4

A siliconized tow of 48.9 ktex having about 122,000 single hole hollow filaments of 4.0 dtex/fil, CHI 10, and of silicone concentration about 0.4% (calculated on the weight of fibers) was opened on a tow spreader. The opened tow was carefully hand-laid into a carton and shipped for bonding and cutting trials. The tow was unpacked, tensioned and fed into the ultrasonic machine. Since unpacking and handling of the opened tow caused a lot of filament snagging, resulting in broken filaments which created wraps on the bonding roll, a roll of paper was used as a carrier under the tow, passing between the patterned bonding roll and the tow. A higher pressure was required to achieve the same bonding as without the paper, 1.5 kg/cm$^2$ versus 1.0 kg/cm$^2$ (see Example 4A). The bonded tow was opened by stretching it in the width by hand then cutting on a commercial Lummus cutter to 24 mm.

The use of the paper interliner has reduced the number of unbonded filaments from 31.8% (Example 4A) to 13.8%. This percentage should be further reduced by using equipment specifically designed for this process, by ensuring better parallelization of the fibers and by controlling uniformity of thickness of the tow bundle.

Example 4A

This Example used the same opened tow feed and the same bonding pattern and speed, except that no paper interliner was used. Less pressure was required versus Example 4 (from 1.5 kg/cm$^2$ to 1.0 kg/cm$^2$) to achieve the same degree of bonding. The runnability was quite acceptable; only difference in quality was the higher percentage (31.8%) of unbonded filaments.

I believe that, because of the conditions under which these tests were made (i.e., adapting equipment designed for other purposes, and not using equipment specifically designed for use according to the invention), a disproportionately large number of filaments tended to accumulate in the gaps between the bonding sections of the roll, and that the paper reduced the disproportionately large number of unbonded filaments.

Example 5

A siliconized tow of about 46.7 ktex, 6.7 dtex/fil, CHI 9–10, single hole hollow filaments, with a silicone concentration of about 0.36% (calculated per weight of fiber), was processed essentially as described for Example 4, except as indicated in Table 2. Processability was better than for the material of Example 4 (using a paper roll as in Example 4).

Notes: The cutting length settings on the cutter are always higher than the relaxed lengths of the resulting bonded products. CHI (short for chip crimp) is the number of crimps per inch of a tow band in relaxed state. The silicone concentrations were measured by X-ray.

What is claimed is:

1. A process for preparing clusters of bonded thermoplastic fibers that have a crimped configuration and that are 1 to 6 cm in length, comprising the steps of (1) forming the fibers into a stack of superposed webs, with the fibers aligned in a parallel configuration, (2) passing said stack through a bonding zone whereby the thermoplastic fibers in said stack are intermittently bonded together in a pattern, (3) cutting the resulting stack of intermittently bonded fibers, and (4) separating the resulting cut stack into clusters.

2. A process for preparing clusters of bonded thermoplastic fibers, comprising the steps of (1) forming a tow of continuous thermoplastic filaments that have a crimped configuration, (2) passing said tow through a tow spreader to open said tow, passing the opened tow through a bonding zone whereby the thermoplastic filaments in the tow are intermittently bonded together in a pattern of bonded sections, (3) cutting the resulting tow of intermittently bonded filaments, and (4) separating the resulting cut tow into clusters of cut fiber.

3. A process according to claim 2, wherein, after step (2), the intermittently bonded filaments in the tow are spread to separate the bonded sections, before the resulting tow is cut in step (3).

4. A process according to any one of claims 1 to 3, wherein the bonding is performed by ultrasonic energy.

* * * * *